US008448620B2

(12) United States Patent
Terada et al.

(10) Patent No.: US 8,448,620 B2
(45) Date of Patent: May 28, 2013

(54) IGNITION DEVICE ATTACHMENT STRUCTURE FOR INTERNAL COMBUSTION ENGINE

(75) Inventors: Koji Terada, Saitama (JP); Toru Kisaichi, Saitama (JP); Shinsuke Kawakubo, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 250 days.

(21) Appl. No.: 12/880,651

(22) Filed: Sep. 13, 2010

(65) Prior Publication Data

US 2011/0061624 A1 Mar. 17, 2011

(30) Foreign Application Priority Data

Sep. 16, 2009 (JP) ..... 2009-215034

(51) Int. Cl.
*F02P 1/00* (2006.01)

(52) U.S. Cl.
USPC ..... 123/169 R; 123/169 PA

(58) Field of Classification Search
USPC ..... 123/169 R, 169 PA, 169 P, 195 C, 123/193.5
See application file for complete search history.

(56) References Cited

U.S. PATENT DOCUMENTS

| | | | | |
|---|---|---|---|---|
| 5,979,422 | A * | 11/1999 | Flierl et al. | 123/647 |
| 6,178,957 | B1 * | 1/2001 | Widiger et al. | 123/634 |
| 6,273,733 | B1 * | 8/2001 | Uchiyama | 439/125 |
| 6,308,696 | B1 * | 10/2001 | Kondo et al. | 123/634 |
| 6,427,674 | B1 * | 8/2002 | Wylin | 123/634 |
| 6,873,094 | B2 * | 3/2005 | Hiramatsu et al. | 313/144 |
| 7,059,288 | B2 * | 6/2006 | Merrick et al. | 123/145 A |
| 7,150,274 | B2 * | 12/2006 | Iwami et al. | 123/635 |
| 7,500,459 | B2 * | 3/2009 | Koji | 123/195 C |
| 7,584,733 | B2 | 9/2009 | Takemoto et al. | |
| 2003/0184202 | A1 * | 10/2003 | Hiramatsu et al. | 313/118 |
| 2005/0263145 | A1 * | 12/2005 | Iwami et al. | 123/634 |
| 2008/0092844 | A1 * | 4/2008 | Tsukamoto | 123/195 C |

FOREIGN PATENT DOCUMENTS

JP 2007-327378 A 12/2007

* cited by examiner

*Primary Examiner* — John Kwon
(74) *Attorney, Agent, or Firm* — Birch, Stewart, Kolasch & Birch, LLP

(57) ABSTRACT

An ignition device attachment structure for an internal combustion engine includes an ignition plug tube inserted between a cylinder head cover and an ignition device insertion hole formed in a cylinder head of the internal combustion engine. The ignition plug tube bulges from an upper end of the ignition plug tube to an intermediate portion of the ignition plug tube on a lateral surface of the ignition plug tube.

18 Claims, 6 Drawing Sheets

IGNITION DEVICE ATTACHMENT STRUCTURE FOR INTERNAL COMBUSTION ENGINE

CROSS-REFERENCE TO RELATED APPLICATIONS

This nonprovisional application claims priority under 35 U.S.C. §119(a) on Patent Application No. 2009-215034, filed in Japan on Sep. 16, 2009, the entirety of which is incorporated herein by reference.

BACKGROUND OF THE INVENTION

1. Field of the Invention

The present invention relates to an ignition device attachment structure, and more particular, to an ignition device attachment structure for an internal combustion engine.

2. Background of the Invention

There has been known an internal combustion engine in which an ignition plug tube is inserted between an ignition device insertion hole formed in a cylinder head and a cylinder head cover (see e.g. Japanese Patent Laid-Open No. 2007-327378). In this internal combustion engine, an ignition plug as the ignition device is inserted into the ignition plug tube and then inserted into the ignition device insertion hole.

In the above-mentioned traditional configuration, however, a projecting object may be installed on an upper portion of the cylinder head, or accessories may be arranged above the cylinder head. In such a case, they become obstructive so that the ignition plug cannot be inserted vertically to the cylinder head. Therefore, the ignition plug has to be arranged at a slant to avoid the projecting object or accessories. If the ignition plug is inclined too much, the ignition plug interferes with a rocker arm or a valve. It is necessary, therefore, to increase an angle formed between an intake valve and an exhaust valve, which poses a problem with the increased width of the cylinder head.

SUMMARY OF THE INVENTION

The present invention has been made in view of the above-mentioned situations and aims to provide an ignition device attachment structure for an internal combustion engine that can reduce an arrangement inclination of an ignition device.

To achieve the above object, in a first aspect of the present invention, in an ignition device attachment structure for an internal combustion engine in which an ignition plug tube is inserted between a cylinder head cover and an ignition device insertion hole formed in a cylinder head of the internal combustion engine, the ignition plug tube bulges from an upper end to an intermediate portion on an lateral surface thereof.

With the configuration described above, the ignition plug tube bulges from the upper end portion to the intermediate portion on the one lateral surface thereof. For example, an obstacle encountered when the ignition device is inserted may lie above the cylinder head cover on the bulging side of the ignition plug tube. Even in such a case, it is possible to obliquely insert the ignition device from the side opposite to the bulging side of the ignition plug tube. Thus, the arrangement inclination of the ignition device can be reduced, and the cylinder head can be downsized without increasing the width of the cylinder head.

In a second aspect of the present invention, an upper end portion of the ignition plug tube may be provided with a flange portion holding a seal member, and sealing may be provided between an upper surface of the seal member and a lower surface of the cylinder head cover in contact with the upper surface of the seal member.

Therefore, sealing is vertically provided between the seal member and the cylinder head cover. Accordingly, a space necessary for attachment of the ignition device can be reduced compared with, for example, the case where sealing is provided between the seal member and the cylinder head cover in the radial direction of the ignition plug tube. Therefore, this can downsize the cylinder head.

In a third aspect of the present invention, a valve train mechanism of the internal combustion engine may be driven by a camshaft provided in a camshaft holder of the cylinder head, and the seal member may be provided to overlap the camshaft holder in a vertical direction. Therefore, the seal member can be disposed close to the camshaft holder, and the ignition device insertion hole can be disposed closer to the central side of the cylinder head.

In a fourth aspect of the present invention, the flange portion may be provided to partially overlap an attachment bolt of the camshaft holder and an overlapping portion may be notched. Since the flange portion is provided to partially overlap the attachment bolt of the camshaft holder, it can be disposed close to the attachment bolt of the camshaft holder. Therefore, the ignition device insertion hole can be disposed closer to the central side of the cylinder head. Additionally, since the overlapping portion is notched, the flange portion does not interfere with the attachment bolt of the camshaft holder. Therefore, the camshaft can be mounted and dismounted with ignition plug tube remaining attached.

In a fifth aspect of the present invention, a valve train mechanism of the internal combustion engine may be driven by a rocker arm and the ignition device insertion hole may be provided to overlap a rocker arm shaft in an axial direction thereof. Therefore, the ignition device insertion hole can be disposed closer to the rocker arm shaft. Thus, the ignition device insertion hole can be disposed closer to the central side of the cylinder head.

In a sixth aspect of the present invention, the flange portion may be provided to partially overlap an attachment bolt of the rocker arm shaft and an overlapping portion may be notched. Since the flange portion is provided to partially overlap the attachment bolt of the rocker arm shaft, it can be disposed close to the attachment bolt of the rocker arm shaft. Therefore, the ignition device insertion hole can be disposed on the central side of the cylinder head. Additionally, since the overlapping portion is notched, the flange portion does not interfere with the attachment bolt of the rocker arm shaft. Therefore, the rocker arm can be mounted and dismounted with the ignition plug tube remaining attached.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
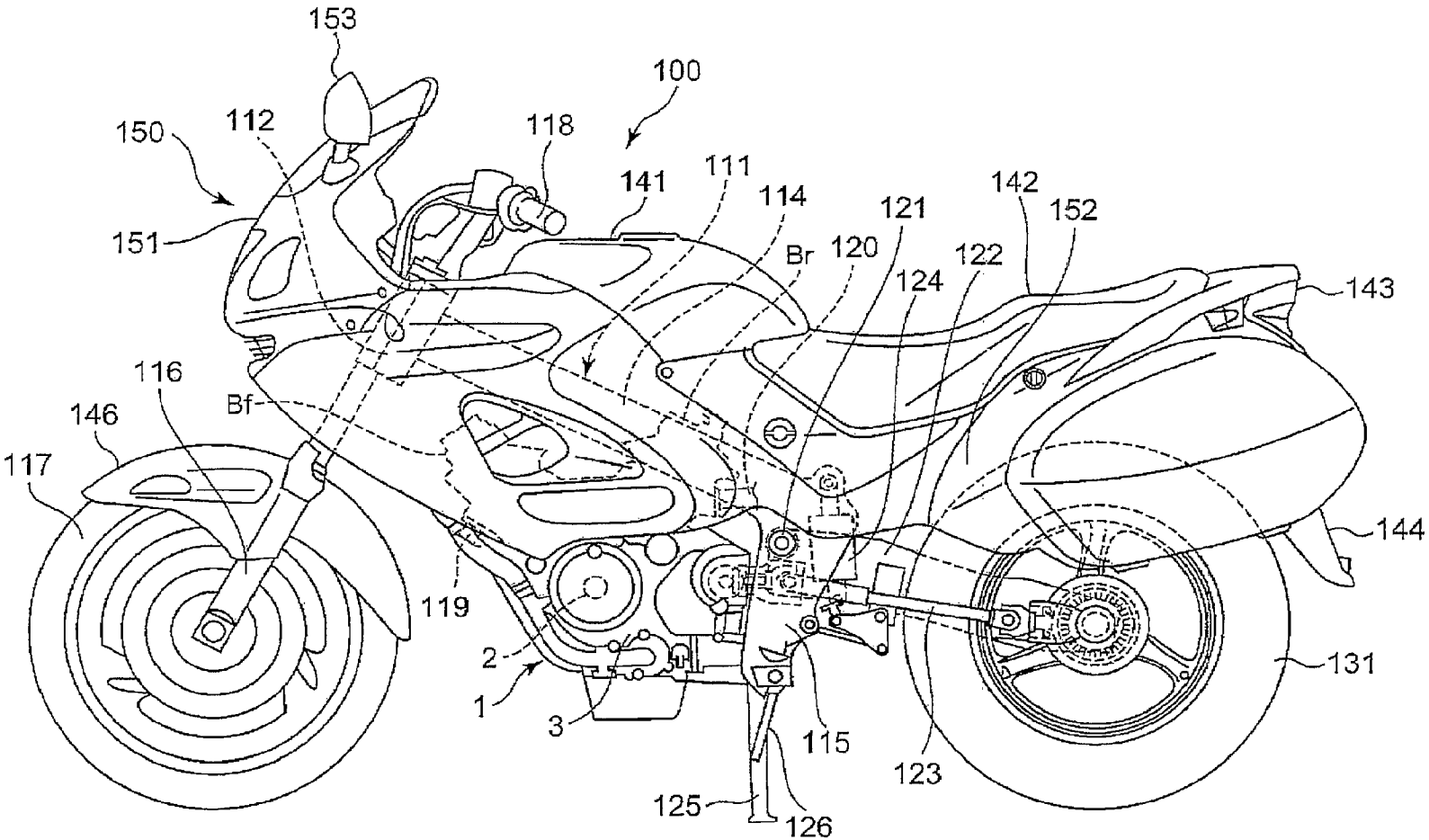
FIG. 1 is a lateral view of a motorcycle to which an ignition plug attachment structure for an internal combustion engine according to an embodiment of the present invention is applied.

The present invention will now be described in detail with reference to the accompanying drawings, wherein the same reference numerals will be used to identify the same or similar elements throughout the several views. It should be noted that the drawings should be viewed in the direction of orientation of the reference numerals. An embodiment of the present invention will hereinafter be described with reference to the drawings.

FIG. 1 is a lateral view of a motorcycle to which an ignition plug attachment structure for an internal combustion engine according to an embodiment of the present invention is applied. The directions such as front and rear or back, left and right, and upside and downside in the following description are based on a vehicle body.

A body frame 111 of a motorcycle 100 includes a head pipe 112 located in the front portion of the vehicle body; a pair of left and right main frames extending rearward from the head pipe 112 to the center of the vehicle body; a pair of pivot plates 115 extending downward from the corresponding rear ends of the main frames 114; and rear frames (not illustrated) extending from the corresponding rear ends of the main frames 114 to the rear portion of the vehicle.

A front fork 116 is pivotably attached to the head pipe 112. A front wheel 117 is rotatably supported by the lower end of the front fork 116. A steering handlebar 118 is attached to the upper portion of the head pipe 112.

A fore-aft V-form 4-cylinder internal combustion engine (also called the engine or the power unit) is disposed below the main frames 114. The internal combustion engine 1 is laterally arranged such that a crankshaft 2 is oriented in a right-left direction, i.e., in a horizontal direction. The engine is of a 4-valve OHC water-cooled type and includes a crankcase 3. A front bank (cylinder) Bf and a rear bank (cylinder) Br, each of which includes two cylinders, are tilted forward and rearward, respectively, from the crankcase 3 are configured in a V-shape. In this way, the engine is configured as a narrow-angle V-form engine having a bank angle smaller than 90 degrees.

A pair of left and right exhaust pipes 119 is connected at respective one ends to an exhaust port of the front bank Bf and extends downward from the exhaust port. The exhaust pipes 119 are then arranged to extend toward the rear of the vehicle body and then collectively connected to a pair of corresponding left and right exhaust pipes 120 extending from an exhaust port of the rear bank Br. This exhaust pipe is connected via a single exhaust tube (not illustrated) to a muffler (not illustrated) installed rearward of the internal combustion engine 1.

A pivot shaft 121 is disposed rearward of the internal combustion engine 1. A rear fork 122 is attached to the pivot shaft 121 so as to be vertically swingable around the pivot shaft 121. A rear wheel 131 is rotatably supported by the rear end of the rear fork 122. The rear wheel 131 and the engine 1 are connected to each other by a drive shaft 123 installed inside the rear fork 122. Rotational power from the engine 1 is transmitted to the rear wheel 131 via the drive shaft 123. A rear cushion 124 is spanned between the rear fork 122 and the body frame 111 to absorb impact from the rear fork 122.

A stand 125 is provided at the rear portion of the engine 1 to park the vehicle body. In addition, a side stand 126 is provided at the lower portion of a left lateral surface of the engine 1.

A fuel tank 141 is mounted on the main frames 114 so as to cover the internal combustion engine 1 from above. A seat 142 is located in rear of the fuel tank 141 and supported by the rear frames. A tail lamp 143 is disposed in rear of the seat 142. A rear fender 144 is disposed below the tail lamp 143 so as to cover the rear wheel 131 from above.

The motorcycle 100 includes a resin-made body cover 150 covering the vehicle body. The body cover 150 includes a front cover 151 continuously covering from the front of the body frame 111 to the front of the engine 1 and a rear cover 152 covering the underside of the seat 142. A pair of left and right mirrors 153 is attached to the upper portion of the front cover 151. A front fender 146 is attached to the front fork 116 to cover the front wheel 117 from above.

Figure 2:
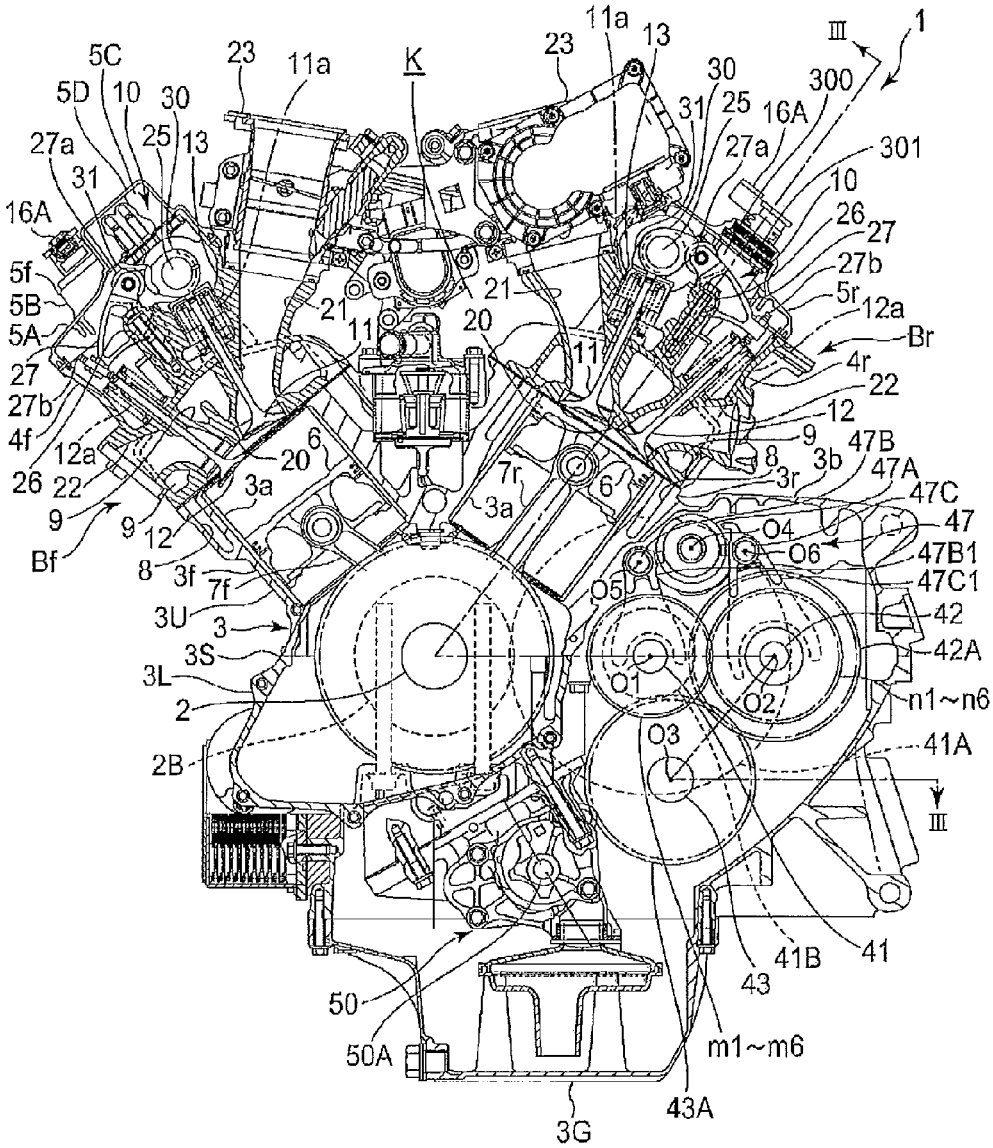
FIG. 2 is a cross-sectional view of an internal combustion engine according to an embodiment of the present invention.

FIG. 2 is a cross-sectional view of the internal combustion engine 1. Incidentally, a description is given in FIG. 2 by taking the upside and downside of the figure as those of the engine 1 and by taking the left and right of the figure as the front side and rear side, respectively, of the engine 1.

A V-bank space K formed in a V-shape as viewed from the side is defined between the front bank Bf and the rear bank Br.

The crankcase 3 is configured to be vertically split into an upper crankcase (upper case member) 3U and a lower crankcase (lower case member) 3L. The crankshaft 2 is rotatably supported so as to be put between the crankcases 3U, 3L. A front cylinder block 3*f* and a rear cylinder block 3*r* in each of which the two cylinders are aligned right and left are formed integrally with the upper crankcase 3U so as to extend obliquely upward to be V-shaped as viewed from the side.

An oil pan 3G in which oil for the internal combustion engine 1 (lubricating oil) is stored is installed in the lower portion of the lower crankcase 3L so as to protrude downward. An oil pump 50 adapted to circulate oil in the engine 1 is located below the crankshaft 1 in the lower crankcase 3L.

A front cylinder head 4*f* is put on the front cylinder block 3*f* so as to be located forwardly and obliquely upward thereof and fastened thereto by the fastening bolts (not illustrated). A front cylinder head cover 5*f* covers the front cylinder head 4*f* from above. Similarly, a rear cylinder head 4*r* is put on the rear cylinder block 3*r* so as to be located rearwardly and obliquely upward thereof and fastened thereto by the fastening bolts (not illustrated). A rear cylinder head cover 5*r* covers the front cylinder head 4*r* from above.

Each of the front cylinder block 3*f* and the rear cylinder block 3*r* is formed with a cylinder bore 3*a*. A piston 6 is disposed in the cylinder bore 3*a* so as to reciprocate therein. The pistons 6 are connected via the corresponding connecting rods 7*f*, 7*r* to the single crankshaft 2 shared thereby.

Each of the cylinder blocks 3*f*, 3*r* is provided with a water jacket 8 so as to surround the cylinder bore 3*a*. Cooling water flows in the water jacket 8 to cool each of the cylinder blocks 3*f*, 3*r*.

Each of the front cylinder head 4*f* and the rear cylinder head 4*r* is provided with a combustion chamber 20, an intake port 21 and an exhaust port 22 which are located above the corresponding cylinder bore 3*a*. A throttle body 23 adapted to adjust an amount of mixture flowing in the intake port 21 is connected to the intake port 21.

Each of the cylinder heads 4*f*, 4*r* is provided with a water jacket 9 so as to surround the intake ports 21 and the exhaust ports 22. Cooling water flows in the water jacket 9 to cool each of the cylinder heads 4*f*, 4*r*.

In each of the cylinder heads 4*f*, 4*r*, for each cylinder, a pair of intake valves 11 is disposed in an openable and closable manner so as to be biased by the corresponding valve springs 11*a* in a direction of closing the intake port 21 (a valve-closing direction). In addition, a pair of exhaust valves 12 is disposed in an openable and closable manner so as to be biased by the corresponding valve springs 12*a* in a direction of closing the exhaust port 22.

The intake valves 11 and the exhaust valves 12 are drivingly opened and closed by a uni-cam valve train 10 in which they are driven by a camshaft 25 disposed in each of the cylinder heads 4*f*, 4*r*.

The valve train 10 includes a camshaft 25 rotatably supported by each of the cylinder heads 4*f*, 4*r* above the intake valves 11; a rocker arm shaft 26 having an axis parallel to the camshaft 25 and secured to each of the cylinder heads 4*f*, 4*r*; and a rocker arm 27 swingably supported by the rocker arm shaft 26.

The camshaft 25 has an intake cam 30 and an exhaust cam 31 protruding from the outer circumference of the camshaft 25 and is rotated in synchronization with the rotation of the crankshaft 2. The intake cam 30 and the exhaust cam 31 have a cam profile whose distance (radius) from the center to the outer circumference is not uniform. In this way, the intake cam 30 and the exhaust cam 31 are rotated to vary in radius to pump the intake valve 11 and the exhaust valve 12, respectively.

A valve lifter 13 is provided between the camshaft 25 and the intake valve 11 so as to be slidably fitted to each of the cylinder heads 4*f*, 4*r* at a position below the camshaft 25.

A roller 27*a* is provided at one end of the rocker arm 27 pivotally supported by the rocker arm shaft 26 so as to be in rolling contact with the exhaust cam 31. In addition, a tappet screw 27*b* in abutment against the upper end of the exhaust valve 12 is threadedly engaged with the other end of the rocker arm 27 so as to be able to adjust an advancement-retreat position.

The intake cam 30 and the exhaust cam 31 are rotated integrally with the camshaft 25 so that the intake cam 30 depresses the intake valve 11 via the valve lifter 13 and the exhaust cam 31 depresses the exhaust valve 12 via the rocker arm 27. In this way, the intake port 21 and the exhaust port 22 are opened and closed at predetermined timing determined by the rotational phase of the intake cam 30 and of the exhaust cam 31.

Figure 3:
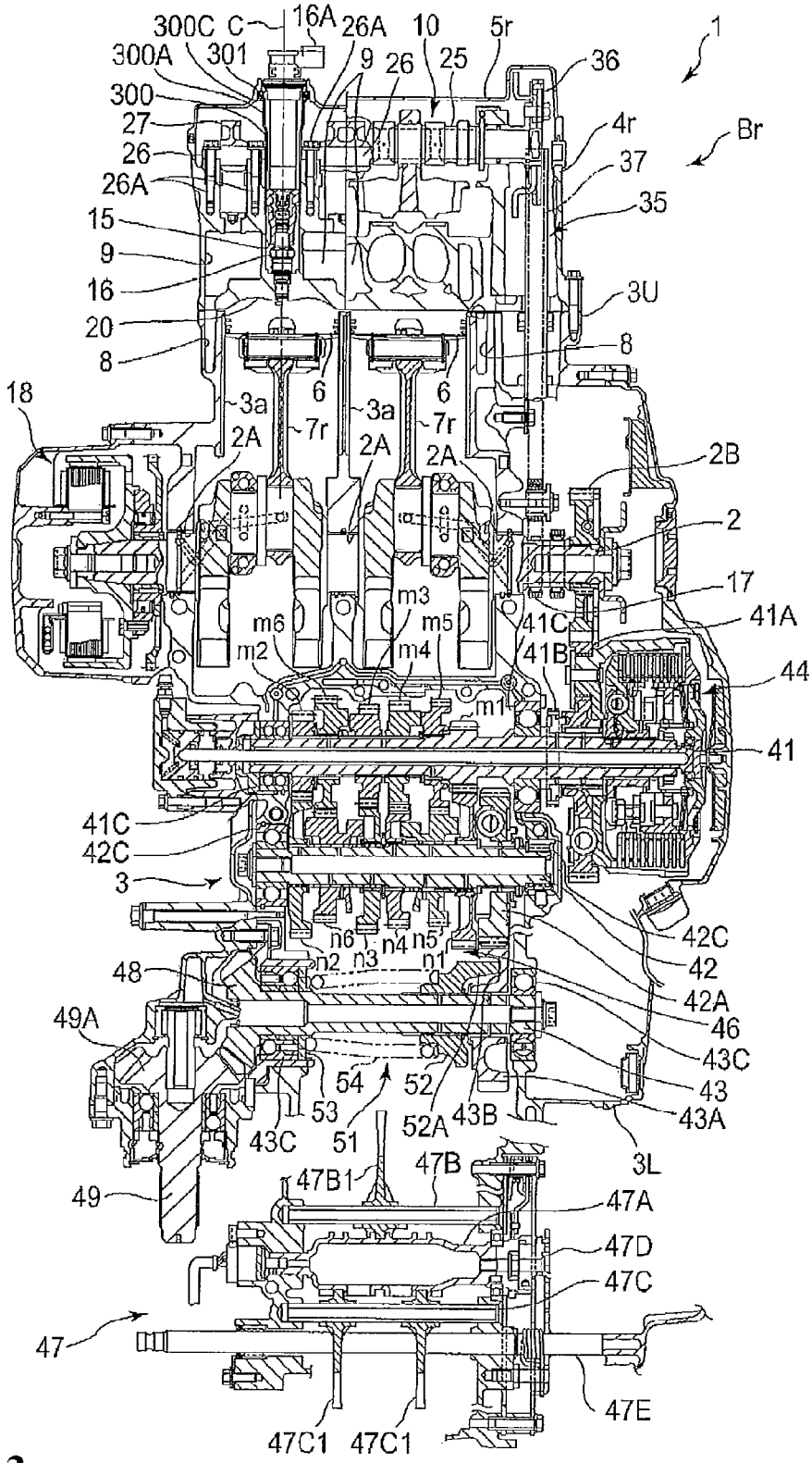
FIG. 3 is a cross-sectional view taken along line III-III of FIG. 2.

FIG. 3 is a cross-sectional view taken along line III-III of FIG. 2. FIG. 3 illustrates the cross-section of the rear bank Br. Since the inside of the front bank Bf is configured similarly to that of the rear bank Br, the explanation of the front bank Bf is omitted.

Referring to FIG. 3, a plug insertion hole (ignition device insertion hole) 15 is formed in each cylinder of the cylinder head 4*r* and on the cylinder axis C which is a central axis of the cylinder bore 3*a*. An ignition plug 16 (an ignition plug of the right cylinder is not illustrated) is disposed with its distal end facing the inside of the combustion chamber 20.

The crankshaft 2 is rotatably supported in the crankcase 3 via metal bearings 2A provided at both ends and an intermediate portion in the axial direction thereof.

A camshaft drive sprocket 17 adapted to output rotation of the crankshaft 2 is provided on one end side of the crankshaft 2. A cam chain chamber 35 is provided on the side of the camshaft drive sprocket 17 of the internal combustion engine 1 so as to extend vertically in each of the banks Bf, Br. A driven sprocket 36 rotated integrally with the camshaft 25 is secured to one end of the camshaft 25 and located in the cam chain chamber 35. An endless cam chain 37 is wound around the driven sprocket 36 and the camshaft drive sprocket 17. The camshaft 25 is designed to be rotated at half the rotation speed of the crankshaft 2 via the cam chain 37 and the driven sprocket 36.

A generator 18 as a dynamo is installed on the other end side of the crankshaft 2.

Each of a main shaft 41, a counter shaft 42 and an output shaft 43 is disposed in the crankcase 3 in parallel to the crankshaft 2. These shafts 41, 42, 43 including the crankshaft 2 constitute a gear transmission mechanism adapted to transmit the rotation of the crankshaft 2 in an order of the main shaft 41, the counter shaft 42 and the output shaft 43.

As illustrated in FIG. 2, the crankshaft 2 is disposed on a mating surface 3S between the upper crankcase 3U and the lower crankcase 3L. The main shaft 41 is disposed rearward of the crankshaft 2, and the counter shaft 42 is disposed rearward of the main shaft 41. The main shaft 41 and the counter shaft 42 are disposed on the mating surface 3S. The output shaft 43 is disposed forward of and below the counter shaft 42. In other words, the respective axial centers O1 and O2 of the main shaft 41 and the counter shaft 42 are located anteriorly and posteriorly, respectively, on the mating surface 3S, and an axial center O3 of the output shaft 43 is located rearward of the axial center O1 of the main shaft 41 and forward of and below the axial center O2 of the counter shaft 42.

Incidentally, FIG. 3 is a cross-sectional view taken along a cross-section connecting the rear bank Br, the crankshaft 2, the main shaft 41, the counter shaft 42 and the output shaft 43 together with the corresponding straight lines.

A crank-side drive gear 2B adapted to rotate the main shaft 41 is secured to an end of the crankshaft 2 on the side of the cam chain chamber 35. In addition, the crank-side drive gear 2B meshes with a main shaft-side driven gear 41A of the main shaft 41. The main shaft 41 is supported via the bearings 41C provided at both the ends thereof.

The main shaft-side driven gear 41A is provided on the main shaft 41 for relative rotation and connected to a clutch mechanism 44. The operation of the clutch mechanism 44 can connect and disconnect the transmission of the power between the crankshaft 2 and the main shaft 41.

The main shaft-side driven gear 41A is provided with an oil pump drive gear 41B adapted to drive an oil pump 50 (see FIG. 2). The oil pump drive gear 41B is rotated integrally with the main shaft-side driven gear 41A regardless of on-and-off of the clutch mechanism 44. This transmits the rotation of the crankshaft 2 via the drive chain to a driven gear secured to a drive shaft 50A of the oil pump 50 for driving the oil pump 50 as illustrated in FIG. 2.

As illustrated in FIG. 3, the counter shaft 42 is supported by the bearings 42C provided at both the ends thereof. Speed-change gear groups are arranged to straddle between the counter shaft 42 and the main shaft 41, which constitutes a transmission device 46. More specifically, drive gears for six speeds m1 to m6 are provided on the main shaft 41. Driven gears for six speeds n1 to n6 are provided on the counter shaft 42. The drive gears m1 to m6 and the driven gears n1 to n6 are arranged such that the corresponding speed-change stages mesh with each other to constitute speed-change gear pairs (gear combinations) corresponding thereto. Incidentally, the speed-change gear pairs are reduced in reduction ratio in the order from the first-speed gear pair to the sixth-speed gear pair (i.e., become higher-speed gears). The first-speed gear pair m1, n1 largest in reduction ratio is disposed on one end side of the main shaft 41 supporting the main shaft-side driven gear 41A. The second-speed gear pair m2, n2 is disposed on the other end side of the main shaft 41. The fifth-speed gear pair m5, n5, the fourth-speed gear pair m4, n4, the third-speed gear pairs m3, n3 and the sixth-speed gear pairs m6, n6 are arranged between the first-speed gear pair m1, n1 and the second-speed gear pair m2, n2 in the order from the one end side.

The third-speed drive gear m3 and the fourth-speed drive gear m4 on the main shaft 41 are integrally spline-connected to the main shaft 41. In addition, they can be axially shifted as a shifter and selectively attached to or detached or from the adjacent fifth-speed drive gear m5 or sixth-speed drive gear m6. The fifth-speed driven gear n5 and the sixth-speed driven gear n6 on the counter shaft 42 are configured to be spline-connected to the counter shaft 42. In addition, they can be axially shifted as a shifter and selectively attached to or detached or from the adjacent fourth-speed driven gear n4 or third-speed driven gear n3.

The third-speed drive gear m3 and fourth-speed drive gear m4 serving as a shifter on the main shaft 41 and the fifth-speed driven gear n5 and sixth-speed driven gear n6 on the counter shaft 42 are displaced by a speed-change switching mechanism 47 (see FIG. 2) for shifting.

As illustrated in FIG. 2, the speed-change switching mechanism 47 includes a shift drum 47A parallel to the shafts 41 to 43. The shift drum 47A is connected to a shift spindle (also called a shift shaft) 47E (see FIG. 3) via a ratchet mechanism 47D (see FIG. 3) for controlling a turning amount of the shift drum 47A. A gear change pedal (not illustrated) shift-operated by an operator is attached to an end (e.g., the left end of the vehicle body) of a shift spindle 47E. The gear change pedal is turned along with the shift-operation to turn the shift drum 47A via the ratchet mechanism 47D.

The shift drum 47A is disposed between and above the main shaft 41 and the counter shaft 42. In addition, the shift drum 47A is disposed so that its axial center O4 is located rearward of the axial center O3 of the output shaft 43. Fork shafts 47B and 47C are disposed forward and rearward, respectively, of and parallel to the shift drum 47A. The fork shaft 47B is disposed forward of the shift drum 47A so that its axial center O5 is located slightly below the axial center O4 of the shift drum 47A. The fork shaft 47C is disposed rearward of the shift drum 47A so that its axial center O6 is located at a height approximately equal to the axial center O4 of the shift drum 47A.

The fork shaft 47B supports a shift fork 47B1 to be engaged with the shifter of the main shaft 41. The fork shaft 47C supports a shift fork 47C1 to be engaged with the shifter of the counter shaft 42. The speed-change gear pairs are changed by shifting the shift forks 47B1, 47C1 of the speed-change switching mechanism 47. The rotation of the main shaft 41 is transmitted to the counter shaft 42 via a speed-change gear pair thus changed. As illustrated in FIG. 3, the counter shaft 42 has an intermediate drive gear 42A adapted to transmit the rotation of the counter shaft 42 to the output shaft 43.

The output shaft 43 is supported by the bearings 43C provided at both ends of the counter shaft 42 and has a driven gear 43A meshing with the intermediate drive gear 42A. A cam-type torque damper 51 is disposed on the output shaft 43 adjacent to the driven gear 43A. The cam-type torque damper 51 is adapted to alleviate torque variations upon undergoing the same. The cam-type torque damper 51 is provided with a cylindrical member 52 which is spline-connected to the output shaft 43 in an axially shiftable manner. The cylindrical member 52 is formed, on an end face close to the driven gear 43A, with a projecting cam 52A meshing with a concave cam 43B formed on the driven gear 43A. A spring-receiving member 53 is secured to the general center of the output shaft 43. A coil spring 54 is installed between the cylindrical member 52 and the spring-receiving member 53 so as to bias the cylindrical member 52 toward the driven gear 43A. The cam-type torque damper 51 is configured to include the cylindrical member 52, the spring-receiving member 53 and the coil spring 54.

The output shaft 43 is provided at the left end integrally with a drive bevel-gear 48. The drive bevel-gear 48 meshes with a driven bevel-gear 49A provided integrally with a front end of a drive shaft 49. The drive shaft 49 extends in the back and forth direction of the vehicle body. This transmits the rotation of the output shaft 43 to the drive shaft 49.

An internal layout of the internal combustion engine 1 is described next with reference to FIG. 2.

In the internal combustion engine 1, the main shaft 41 is disposed rearward of the crankshaft 2, and the counter shaft 42 is disposed rearward of the main shaft 41. Therefore, the crankshaft 2, the main shaft 41 and the counter shaft 42 are arranged in the order from the front to back. Thus, the vertical length of the crankcase 3 can be shortened. With this configuration, although the main shaft-side driven gear 41A secured to the main shaft 41 is large in diameter, the main shaft-side driven gear 41 does not project upward compared with the case where the main shaft is disposed above the crankshaft and the counter shaft. Therefore, it is possible to suppress the upward protrusion of the crankcase 3. Thus, it is possible to dispose auxiliaries between the rear bank Br and the upper surface 3*b* of the crankcase 3.

Further, the main shaft 41 and the counter shaft 42 are disposed on the mating surface 3S between the upper and lower crankcases 3U, 3L. Therefore, the configurations of the bearings 41C, 42C of the main shaft 41 and the counter shaft 42 can be simplified to facilitate the assembly of the main shaft 41 and the counter shaft 42.

Since the output shaft 43 is disposed forward of the counter shaft 42, the back-and-forth length of the crankcase 3 can be shortened compared with the case where the output shaft 43 is disposed rearward of the counter shaft 42. The output shaft 43 is located below the counter shaft 42 and disposed at one of the apexes of a triangle along with the main shaft 41 and the counter shaft 42. The output shaft 43 is disposed by effective use of the space between the main shaft 41 and the counter shaft 42. It is possible to suppress the downward protrusion of the crankcase 3 resulting from the fact that the output shaft 43 is disposed forward of the counter shaft 42. Therefore, the back-and-forth length of the crankcase 3 can be shortened. In addition, the vertical length of the crankcase 3 can be shortened. Thus, the internal combustion engine 1 can be reduced in size and weight.

In this way, since the back-and-forth length of the crankcase 3 can be shortened to shorten a wheelbase, it is possible to make the motorcycle 100 (see FIG. 1) compact and to improve the turning performance of the motorcycle 100.

Since the shift drum 47A is disposed between and above the main shaft 41 and the counter shaft 42, the back-and-forth length of the crankcase 3 can be shortened compared with the case where the shift drum 47A is disposed rearward of the counter shaft 42. The shift drum 47A is disposed at one of the apexes of a triangle along with the main shaft 41 and the counter shaft 42. The shift drum 47A is disposed by effective use of the space between the main shaft 41 and the counter shaft 42. Therefore, it is possible to suppress the upward protrusion of the crankcase 3 resulting from the fact that the shift drum 47*a* is disposed above the main shaft 41 and the counter shaft 42, and to shorten the vertical length of the crankcase 3. Thus, it is possible to arrange auxiliaries between the rear bank Br and the upper surface 3*b* of the crankcase 3. The distance between the shift drum 47A and the main shaft 41 and between the shift drum 47A and the counter shaft 42 can be reduced. Therefore, the shift forks 47B1, 47C1 supported by the respective fork shafts 47B, 47C can be shortened to make the internal combustion engine 1 small and light.

The shift drum 47A is disposed so that its axial center O4 is located rearward of the axial center O3 of the output shaft 43. Therefore, the vertical length of the crankcase 3 can be shortened compared with the case where the axial center of the shift drum and that of the output shaft are arranged one on the other. Thus, it is possible to arrange auxiliaries between the rear bank Br and the upper surface 3*b* of the crankcase 3.

In addition, the fork shaft 47B is disposed at one of the apexes of a triangle along with the main shaft 41 and the shift drum 47A. The fork shaft 47B is disposed by effective use of the space between the main shaft 41 and the shift drum 47A. Therefore, it is possible to suppress the upward protrusion of the crankcase 3 resulting from the fact that the fork shaft 47B is disposed above the main shaft 41, so that the vertical length of the crankcase 3 can be shortened. Thus, it is possible to arrange auxiliaries between the rear bank Br and the upper surface 3*b* of the crankcase 3. In addition, since the distance between the fork shaft 47B and the main shaft 41 and between the fork shaft 47B and the shift drum 47A can be reduced to shorten the shift fork 47B 1 supported by the fork shaft 47B, the internal combustion engine 1 can be reduced in size and weight.

Similarly, the fork shaft 47C is disposed at one of the apexes of a triangle along with the counter shaft 42 and the shift drum 47A. The fork shaft 47C is disposed by effective use of the space between the counter shaft 42 and the shift drum 47A. Therefore, it is possible to suppress the upward protrusion of the crankcase 3 resulting from the fact that the fork shaft 47C is disposed above the counter shaft 42 and the vertical length of the crankcase 3 can be shortened. Thus, it is possible to arrange auxiliaries between the rear bank Br and the upper surface 3*b* of the crankcase 3. In addition, since the distance between the fork shaft 47C and the counter shaft 42 and between the fork shaft 47C and the shift drum 47A can be reduced to shorten the shift fork 47C1 supported by the fork shaft 47C, the internal combustion engine 1 can be reduced in size and weight.

An attachment structure for an ignition plug 16 is described next in detail.

Figure 4:
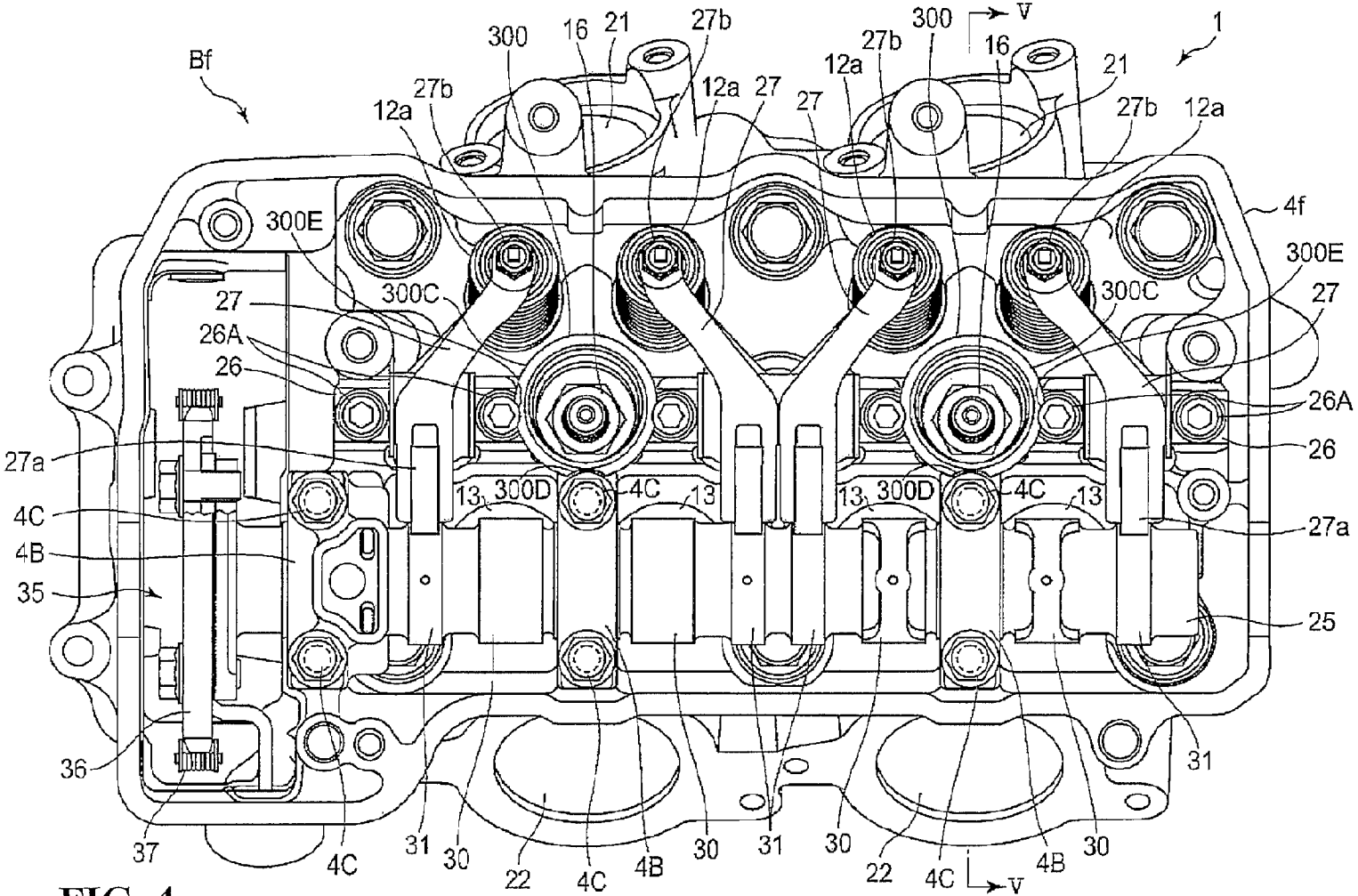
FIG. 4 is a plan view of a front bank Bf according to an embodiment of the present invention.
Figure 5:
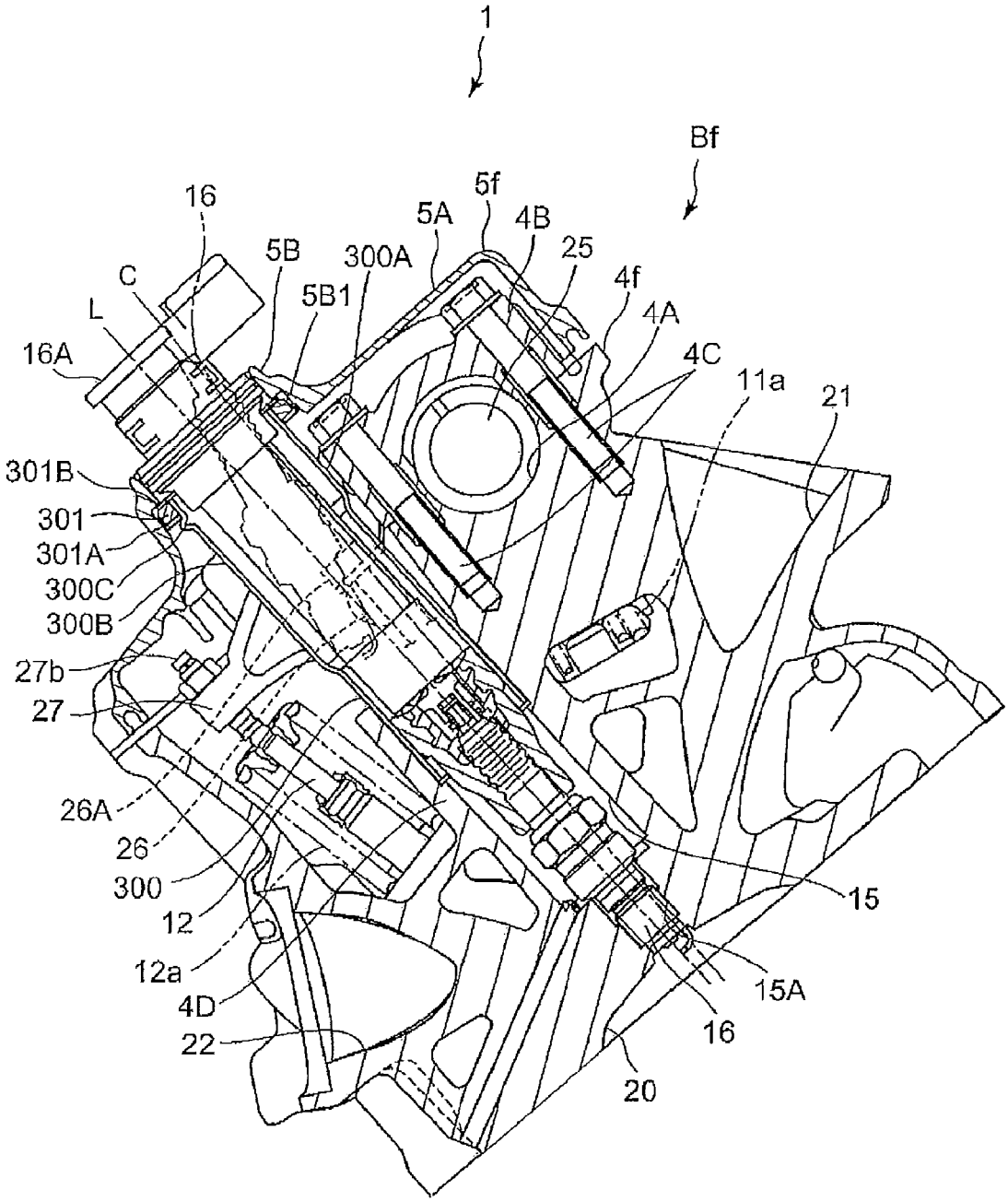
FIG. 5 is a cross-sectional view taken along line V-V of FIG. 4.
Figure 6B:
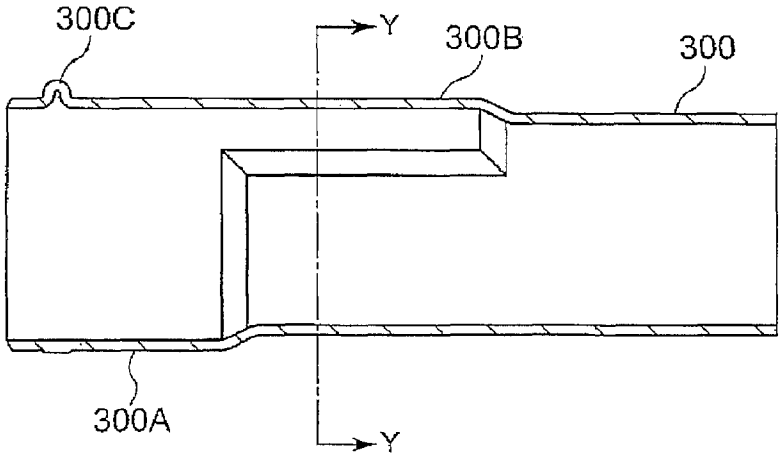
FIG. 6(B) is a cross-sectional view take along line X-X of FIG. 6(A)
Figure 6C:
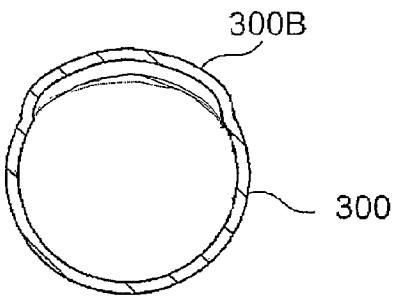
FIG. 6(C) is a cross-sectional view taken along line Y-Y of FIG. 6(B).
Figure 6A:
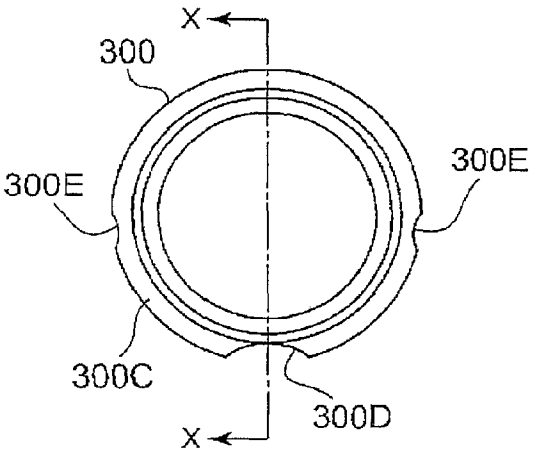
FIG. 6(A) is a plan view of the ignition plug tube according to an embodiment of the present invention.

FIG. 4 is a plan view of the front bank Bf with the cylinder head cover 5*f*, an ignition coil and a seal member removed. Incidentally, a description with FIG. 4 is given by taking the upside and downside of the figure as the front and back or rear, respectively, of the internal combustion engine 1 and by taking the left and right of the figure as the left and right, respectively, of the engine 1. FIG. 4 illustrates the front bank Bf. Since the inside of the rear bank Br is configured similarly to that of the front bank Bf, the explanation of the rear bank Br is omitted. FIG. 5 is a cross-sectional view taken along line V-V of FIG. 4. FIGS. 6(A)-(C) illustrates an ignition plug tube. FIG. 6(A) is a plan view of the ignition plug tube, FIG. 6(B) is a cross-sectional view take along line X-X of FIG. 6(A), and FIG. 6(C) is a cross-sectional view taken along line Y-Y of FIG. 6(B).

Referring to FIGS. 4 and 5, the camshaft 25 is put between and supported by a generally semicircular camshaft support portion 4A formed on an upper end portion of the cylinder head 4*f* and camshaft holders 4B disposed at an upper end of the camshaft support portion 4A. The camshaft holder 4B is secured to the cylinder head 4*f* by means of attachment bolts 4C.

As illustrated in FIG. 4, the rocker arms 27 are provided as one pair for each cylinder so as to correspond to the respective exhaust valves 12 (see FIG. 5). The pair of the rocker arms 27 for each cylinder extends from above the corresponding valve springs 12 toward the camshaft 25 so as to broaden with each other. The two rocker arms 27 adjacent to each other between the two cylinders are close to each other on the side of the rollers 27*a*. As described above, each of the rocker arms 27 are pivotally supported by the rocker arm shaft 26 and the rocker arm shafts 26 are respectively secured to the cylinder head 4*f* by the pair of attachment bolts 26A. Incidentally, the two rocker arms 27 adjacent to each other between the two cylinders are supported by the single rocker arm shaft 26.

The plug insertion holes 15 are respectively disposed to be put between the camshaft 25 and the pair of rocker arms 27. In addition, the plug insertion holes 15 are respectively provided to be adjacent to the camshaft holder 4B to overlap the rocker arm shaft 26 in its axial direction. More specifically, the plug insertion holes 15 are respectively disposed to be put between the attachment bolt 4C of the camshaft holder 4B and the attachment bolts 26A of the rocker arm shaft 26.

As illustrated in FIG. 5, the plug insertion hole 15 is formed in a boss 4D provided in the cylinder head 4*f* so that its axial line L is slightly tilted toward the exhaust side with respect to the cylinder axial line C. In this way, the camshaft 25 disposed on the intake side can be disposed close to the cylinder axial line C. Therefore, the cylinder head 4*f* can be reduced in size to provide the large V-bank space K.

A lower portion of an ignition plug tube 300 is inserted into an upper portion of the plug insertion hole 15. The plug insertion hole 15 is formed at a lower end with a plug threaded hole 15A with a small diameter. The plug threaded hole 15A communicates with the general center of a ceiling surface of the combustion chamber 20. The ignition plug 16 is inserted into the ignition plug tube 300, then inserted into the plug insertion hole 15 and threadedly engaged with the plug threaded hole 15A so that an electrode located at the tip thereof faces the combustion chamber 20.

An ignition coil 16A adapted to apply voltage to the ignition plug 16 is connected to the ignition plug 16. The upper end of the ignition coil 16A passes through the ignition plug tube 300, and is exposed to the outside from the cylindrical portion 5B formed on an upper wall 5A of the cylinder head cover 5*f* and secured to the cylinder head cover 5*f* by means of securing means. As illustrated in FIG. 2, the upper end of the ignition coil 16A is close to a protruding wall 5D. This protruding wall 5D internally forms a breather chamber 5C as a result of the upward protrusion of an intake side upper wall 5A.

Referring to FIGS. 5 and 6, the ignition plug tube 300 is formed generally cylindrical and has at its upper end a large-diameter portion 300A formed full-circumferentially greater in diameter than its lower portion. The large-diameter portion 300A is formed so that its lower end may be located above the attachment bolt 26A of the rocker arm shaft 26.

The ignition plug tube 300 is formed on a lateral surface with a bulging portion 300B which bulges on the exhaust side from the upper end portion to generally intermediate portion thereof. The bulging portion 300B is formed to have a maximum radius approximately equal to that of the large-diameter portion 300A and a lower end located above the boss 4D.

The large diameter portion 300A is formed at an upper end portion with a flange portion 300C by folding the large diameter portion 300A in a general U-shape in cross-section to project radially outwardly. As illustrated in FIG. 4, the flange portion 300C is provided to partially overlap the camshaft holder 4B and the rocker arm shaft 26 in a vertical direction. More specifically, the flange portion 300C is provided to partially vertically overlap the attachment bolt 4C adjacent to the ignition plug tube 300 and the two attachment bolts 26A which are adjacent to each other so as to put the ignition plug tube 300 therebetween. The flange portion 300C is formed with notched portions 300D, 300E at the respective portions overlapping the corresponding attachment bolt 4C and two attachment bolts 26A. Incidentally, the ignition plug tube 300 is formed by pressing a carbon steel pipe for mechanical structure.

A seal member 301 is held at the flange portion 300C as illustrated in FIG. 5. The seal member 301 is annularly formed of a soft material. In addition, a washer 301A is burned into the lower surface of the seal member 301. The seal member 301 is attached to the ignition plug tube 300 with its inner diameter allowed to have an interference. The seal member 301 is provided to overlap the camshaft holder 4B in a vertical direction.

A lower portion of the cylindrical portion 5B of the cylinder head cover 5*f* is greater in diameter than its upper portion. In addition, its diameter-varying portion is formed with a lower surface 5B 1 in contact with an upper surface 301B of the seal member 301. The upper surface 301B of the seal member 301 and the lower surface 5B1 of the cylindrical portion 5B are in contact with each other so that they are sealed therebetween. Thus, it is possible to prevent oil in the inner space of the cylinder head 4*f* covered by the cylinder head cover 5*f* from leaking to the outside.

In the internal combustion engine configured as described above, to attach the ignition plug 16, a worker first inserts, from above the internal combustion engine 1, the ignition plug 16 through the cylindrical portion 5B of each of the cylinder head covers 5*f*, 5*r* and then into the ignition plug tube 300 by using a tool with a long shaft. In this case, the head pipe 112 (see FIG. 1) is disposed in front of and above the front bank Bf. Therefore, it is difficult to insert the ignition plug 16 of the front bank Bf into the ignition plug tube 300 from the direction generally perpendicular to the cylinder head 4*f* (the direction along the axial line L of the plug insertion hole 15 in the embodiment).

In the embodiment, the ignition plug tube 300 is formed on the exhaust side with the bulging portion 300B bulging from the upper end portion to the intermediate portion. Therefore, while allowing the tip of the ignition plug 16 to move along the bulging portion 300B so as to avoid the head pipe 112 as indicated with a two-dot chain line in FIG. 5, a worker can tilt the ignition plug 16 toward the intake side with respect to the axial line L of the plug insertion hole 15 and insert it into the ignition plug tube 300. Thus, since it is not necessary to dispose the ignition plug 16 so as to be tilted toward the intake side, the angle formed between the intake valve 11 and the exhaust valve 12 can be made small so that each of the cylinder heads 4*f*, 4*r* can be downsized without broadening the anteroposterior width thereof.

Since the bulging portion 300B is formed on the exhaust side, the ignition plug 16 can be tilted toward the intake side while being made close to the exhaust side. Although the ignition plug 16 is tilted toward the intake side, it is possible to prevent the ignition plug 16 from interfering with the intake side protruding wall 5D. The protruding wall 5D can be disposed close to the plug insertion hole 15 compared with, for example, the case where the bulging portion is provided on the intake side and the ignition plug 16 is tilted toward the intake side. Thus, the anteroposterior width of each of the cylinder heads 4*f*, 4*r* can be made short. In addition, since the camshaft 25 can be disposed close to the ignition plug tube 300, the anteroposterior width of each of the cylinder heads 4*f*, 4*r* can be made short. Further, the rocker arm shaft 26 can be disposed close to the ignition plug tube 300 compared with, for example, the case where the bulging portion is provided on the side of the rocker arm shaft 26; therefore, the left-right directional length of each of the cylinder heads 4*f*, 4*r* can be shortened.

Then, the worker returns the ignition plug 16 tilted toward the intake side to the axial line L of the plug insertion hole 15, inserts it into the plug insertion hole 15 and allows it to be threadedly engaged with the plug threaded hole 15 for fixation. Next, the worker inserts the ignition coil 16A into the ignition plug tube 300 from the cylindrical portion 5B of the cylinder head cover 5*f* and secures it to the cylinder head 4*f* by the securing means. Also in this case, while allowing the tip of the ignition coil 16A to move along the bulging portion 300B, the worker can tilt the ignition coil 16A toward the intake side from the axial line L of the plug insertion hole 15 and insert it into the ignition plug tube 300.

Also, when removing the ignition plug 16 and the ignition coil 16A, the worker can tilt the ignition plug 16 and the ignition coil 16A from the axial line L of the plug insertion hole 15 toward the intake side and pull out them from the ignition plug tube 300 while allowing the tip of the ignition plug 16 and of the ignition coil 16A to move along the bulging portion 300B.

The internal combustion engine 1 is configured such that sealing is made between the upper surface 301B of the seal member 301 and the lower surface 5B1 of the cylinder head cover 5*f*. The seal member 301 and the cylinder head cover 5*fr* provide the vertical sealing. Thus, the space necessary for the attachment of the ignition plug 16 can be made small to downsize each of the cylinder heads 4*f*, 4*r* compared with, for example, the case where the seal member and the cylinder head cover provide sealing therebetween in the radial direction of the ignition plug tube 300. In addition, the seal member 301 is provided to overlap the camshaft holder 4B in the vertical direction. Therefore, the seal member 301 can be disposed close to the camshaft holder 4B. Thus, the plug insertion hole 15 can be disposed closer to the central side of each of the cylinder heads 4*f*, 4*r*.

The flange portion 300C is provided to partially overlap the attachment bolts 4C of the camshaft holder 4B and the attachment bolts 26A of the rocker arm shaft 26 in the vertical direction. The plug insertion hole 15 can be disposed close to the camshaft holder 4B and the rocker arm shaft 26. Thus, the plug insertion hole 15 can be disposed closer to the central side of each of the cylinder heads 4*f*, 4*r*. The flange portion 300C is formed with the notched portions 300D, 300E at the respective portions overlapping the corresponding attachment bolts 4C, 26A. Therefore, the flange portion 300C does not interfere with the attachment bolts 4C, 26A. Thus, the camshaft 25 and the rocker arm 27 can be mounted and dismounted with the ignition plug tube 300 remaining mounted.

The plug insertion hole 15 is provided to overlap the rocker arm shaft 26 in its axial direction. Therefore, the plug insertion hole 15 can be disposed close to the rocker arm shaft 26. Thus, the plug insertion hole 15 can be disposed closer to the central side of each of the cylinder heads 4*f*, 4*r*.

As described above, according to the present embodiment, the ignition plug tube 300 bulges from the upper end portion to the intermediate portion on the one lateral surface thereof. An obstacle (e.g., the head pipe 112) encountered when the ignition plug 16 and the ignition coil 16A are inserted may lie above each of the cylinder head covers 5*f*, 5*r* on the side of the bulging portion 300B of the ignition plug tube 300. Even in such a case, it is possible to obliquely insert the ignition plug 16 from the side opposite the bulging portion 300B of the ignition plug tube 300. Thus, the arrangement inclination of the ignition plug 16 can be reduced so that the cylinder heads 4*f*, 4*f* can each be downsized without increasing the anteroposterior width thereof. An obstacle (e.g., the protruding wall 5D) in the upper portion of each of the cylinder head covers 5*f*, 5*r* located on the side opposite the bulging portion 300B can be located close to the plug insertion hole 15. Thus, the anteroposterior length of each of the cylinder heads 4*f*, 4*r* can be shortened.

According to the present embodiment, the flange portion 300C holding the seal member 301 is installed at the upper end portion of the ignition plug tube 300 to provide sealing between the upper surface 301B of the seal member 301 and the lower surface 5B 1 of each of the cylinder head covers 5*f*, 5*r* in contact therewith. In other words, the seal member 301 and each of the cylinder head covers 5*f*, 5*r* provide the vertical sealing. Therefore, the space necessary for attachment of the ignition plug 16 can be reduced to downsize each of the cylinder heads 4*f*, 4*r* compared with e.g. the case where the seal member and the cylinder head cover provide the sealing in the radial direction of the ignition plug tube 300.

According to the present embodiment, the valve train 10 of the internal combustion engine 1 is driven by the camshaft 25 provided in the camshaft holder 4B of each of the cylinder heads 4*f*, 4*r*. In addition, the seal member 301 is provided to vertically overlap the camshaft holder 4B. Therefore, the seal member 301 can be disposed close to the camshaft holder 4B so that the plug insertion hole 15 can be disposed closer to the central side of each of the cylinder heads 4*f*, 4*r*.

According to the present embodiment, the flange portion 300C is provided to partially overlap the attachment bolts 4C of the camshaft holder 4B. Therefore, the flange portion 300C can be disposed close to the attachment bolts 4C of the camshaft holder 4B. Thus, the plug insertion hole 15 can be disposed closer to the central side of the cylinder head. Additionally, since the overlapping portions are notched, the flange portion 300C does not interfere with the attachment bolts 4C of the camshaft holder 4B. Therefore, the camshaft 25 can be mounted and dismounted with the ignition plug tube 300 remaining mounted.

According to the present embodiment, the valve train 10 of the internal combustion engine 1 is driven by the rocker arm 27, and the plug insertion hole 15 is provided to overlap the rocker arm shaft 26 in its axial direction. Therefore, the plug insertion hole 15 can be disposed close to the attachment bolts 26A of the rocker arm shaft 26. Thus, the plug insertion hole 15 can be disposed closer to the central side of each of the cylinder heads 4*f*, 4*r*.

According to the present embodiment, the flange portion 300C is provided to partially overlap the attachment bolts 26A of the rocker arm shaft 26. Therefore, the flange portion 300C can be disposed close to the attachment bolts 26A of the rocker arm shaft 26. Thus, the plug insertion hole 15 can be disposed closer to the central side of each of the cylinder heads 4*f*, 4*r*. Additionally, since the overlapping portions are notched, the flange portion 300C does not interfere with the attachment bolts 26A of the rocker arm shaft 26. Therefore, the rocker arm 27 can be mounted and dismounted with the ignition plug tube 300 remaining mounted.

The embodiment described above is an aspect of the present invention. As a matter of cause, the embodiment can be modified in a range not departing from the gist of the present invention.

For example, the above-embodiment is described in the case of applying the present invention to the motorcycle illustrated in FIG. 1. However, the invention is not limited to this but may be applied to straddle-ride type vehicles such as other motorcycles. Incidentally, the straddle-ride type vehicles include overall vehicles in which an occupant straddles and mounts a vehicle body, such as three-wheeled vehicles and four-wheeled vehicles classified into ATV (all terrain vehicles) as well as motorcycles (including motorized bicycles).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ignition device attachment structure for an internal combustion engine, comprising:

an ignition plug tube inserted between a cylinder head cover and an ignition device insertion hole formed in a cylinder head of the internal combustion engine, wherein the ignition plug tube has a first bulging portion bulging from an upper end of the ignition plug tube to an intermediate portion of the ignition plug tube on a first lateral surface of the ignition plug tube, and a second bulging portion bulging from the upper end of the ignition plug tube to an upper-intermediate portion of the ignition plug tube on a second lateral surface of the ignition plug tube, and the first bulging portion extends longer from the upper end of the ignition plug tube than the second bulging portion does.

2. The ignition device attachment structure according to claim 1, wherein an upper end portion of the ignition plug tube is provided with a flange portion holding a seal member, and sealing is provided between an upper surface of the seal member and a lower surface of the cylinder head cover in contact with the upper surface of the seal member.

3. The ignition device attachment structure according to claim 2, wherein a valve train mechanism of the internal combustion engine is driven by a camshaft provided in a camshaft holder of the cylinder head, and the seal member is provided to vertically overlap the camshaft holder.

4. The ignition device attachment structure according to claim 3, wherein the flange portion is provided to partially overlap an attachment bolt of the camshaft holder at an overlapping portion of the flange portion, and the overlapping portion of the flange portion is notched.

5. The ignition device attachment structure according to claim 1, wherein a valve train mechanism of the internal combustion engine is driven by a rocker arm, and the ignition device insertion hole is provided to overlap a rocker arm shaft in an axial direction of the ignition device insertion hole.

6. The ignition device attachment structure according to claim 5, wherein the flange portion is provided to partially overlap an attachment bolt of the rocker arm shaft at an overlapping portion of the flange portion, and the overlapping portion of the flange portion is notched.

7. The ignition device attachment structure according to claim 2, wherein the seal member is located above the flange portion, and the flange portion urges the seal member against the lower surface of the cylinder head cover.

8. The ignition device attachment structure according to claim 2, wherein the flange portion extends from the upper end portion of the ignition plug tube outwardly in a radial direction of the ignition plug tube.

9. The ignition device attachment structure according to claim 1, wherein a circumference of the intermediate portion is non-circular.

10. An ignition device attachment structure for an internal combustion engine, comprising:

an ignition plug tube inserted between a cylinder head cover and an ignition device insertion hole formed in a cylinder head of the internal combustion engine, wherein the ignition plug tube has an upper end portion, a lower end portion and an intermediate portion between the upper end portion and the lower end portion, a circumference of the upper end portion being larger than a circumference of the intermediate portion, and the circumference of the intermediate portion is non-circular, and wherein the ignition plug tube has a first bulging portion bulging from the upper end of the ignition plug tube to the intermediate portion of the ignition plug tube on a first lateral surface of the ignition plug tube, and a second bulging portion bulging from the upper end of the ignition plug tube to an upper-intermediate portion of the ignition plug tube on a second lateral surface of the ignition plug tube, and the first bulging portion extends longer from the upper end of the ignition plug tube than the second bulging portion does.

11. The ignition device attachment structure according to claim 10, wherein the upper end portion of the ignition plug tube is provided with a flange portion holding a seal member, and sealing is provided between an upper surface of the seal member and a lower surface of the cylinder head cover in contact with the upper surface of the seal member.

12. The ignition device attachment structure according to claim 11, wherein a valve train mechanism of the internal combustion engine is driven by a camshaft provided in a camshaft holder of the cylinder head, and the seal member is provided to vertically overlap the camshaft holder.

13. The ignition device attachment structure according to claim 12, wherein the flange portion is provided to partially overlap an attachment bolt of the camshaft holder at an overlapping portion of the flange portion, and the overlapping portion of the flange portion is notched.

14. The ignition device attachment structure according to claim 10, wherein a valve train mechanism of the internal combustion engine is driven by a rocker arm, and the ignition device insertion hole is provided to overlap a rocker arm shaft in an axial direction of the ignition device insertion hole.

15. The ignition device attachment structure according to claim 14, wherein the flange portion is provided to partially overlap an attachment bolt of the rocker arm shaft at an overlapping portion of the flange portion, and the overlapping portion of the flange portion is notched.

16. The ignition device attachment structure according to claim 11, wherein the seal member is located above the flange portion and the flange portion urges the seal member against the lower surface of the cylinder head cover.

17. The ignition device attachment structure according to claim 10, wherein the flange portion extends from the upper end portion outwardly in a radial direction of the ignition plug tube.

18. The ignition device attachment structure according to claim 10, wherein a first portion of a circumferential surface of the intermediate portion is aligned with a circumferential surface of the upper end portion, and a second portion of the circumferential surface of the intermediate portion is aligned with a circumferential surface of the lower end portion.

* * * * *